US006158058A

United States Patent [19]

Martens

[11] Patent Number: 6,158,058

[45] Date of Patent: Dec. 12, 2000

[54] VENTILATED TOILET

[76] Inventor: Henry H. Martens, 102-31234 Wheel Avenue, Abbotsford, Canada, V2T 6G9

[21] Appl. No.: 09/145,862

[22] Filed: Sep. 2, 1998

[51] Int. Cl.[7] ..... E03D 9/04

[52] U.S. Cl. ..... 4/216; 4/348

[58] Field of Search ..... 4/213, 347–350, 4/216

[56] References Cited

U.S. PATENT DOCUMENTS

| | | | |
|---|---|---|---|
| 1,205,078 | 11/1916 | Barrow | 4/427 |
| 2,351,560 | 6/1944 | Thompson et al. | 4/213 |
| 2,777,137 | 1/1957 | McFadden et al. | 4/213 |
| 3,069,696 | 12/1962 | Howell | 4/213 |
| 3,230,552 | 1/1966 | Schulz | 4/218 |
| 3,495,282 | 2/1970 | Taggart | 4/213 |
| 3,733,619 | 5/1973 | Smith | 4/72 |
| 3,938,201 | 2/1976 | McGrew | 4/213 |
| 4,094,023 | 6/1978 | Smith | 4/213 |
| 4,165,544 | 8/1979 | Barry | 4/213 |
| 4,222,129 | 9/1980 | Baker | 4/213 |
| 4,232,406 | 11/1980 | Beeghly et al. | 4/213 |
| 4,317,242 | 3/1982 | Stamper | 4/213 |
| 4,402,091 | 9/1983 | Ellis et al. | 4/217 |
| 4,494,255 | 1/1985 | Drummond | 4/213 |
| 4,556,999 | 12/1985 | Lindley | 4/217 |
| 4,620,329 | 11/1986 | Wix | 4/217 |
| 4,800,596 | 1/1989 | Menge | 4/216 |
| 4,893,359 | 1/1990 | Vu et al. | 4/216 |
| 5,179,738 | 1/1993 | Sowards | 4/213 |
| 5,299,327 | 4/1994 | Wilkerson | 4/213 |
| 5,369,811 | 12/1994 | Serre | 4/213 |
| 5,388,280 | 2/1995 | Sim | 4/213 |

*Primary Examiner*—Charles E. Phillips
*Attorney, Agent, or Firm*—John M. Johnson; Kaye, Scholer, Fierman, Hays & Handler LLP

[57] ABSTRACT

A recreational vehicle or boat toilet includes a bowl with a water ingress line to the bowl, and a flush mechanism for emptying the bowl after water from the ingress line has entered the bowl. The recreational vehicle or boat toilet also includes a ventilation apparatus including an odor vent line communicating with the water ingress line and with an exit line leading to the external environment. Additionally, a water overflow line communicates with the water ingress line, with the odor vent line and with the exit line. A vacuum apparatus communicates with the exit line such that the odor passes from the odor vent line, through the exit line and to the external environment, and such that overflow water passes through the water overflow line, through the exit line into the external environment.

3 Claims, 3 Drawing Sheets

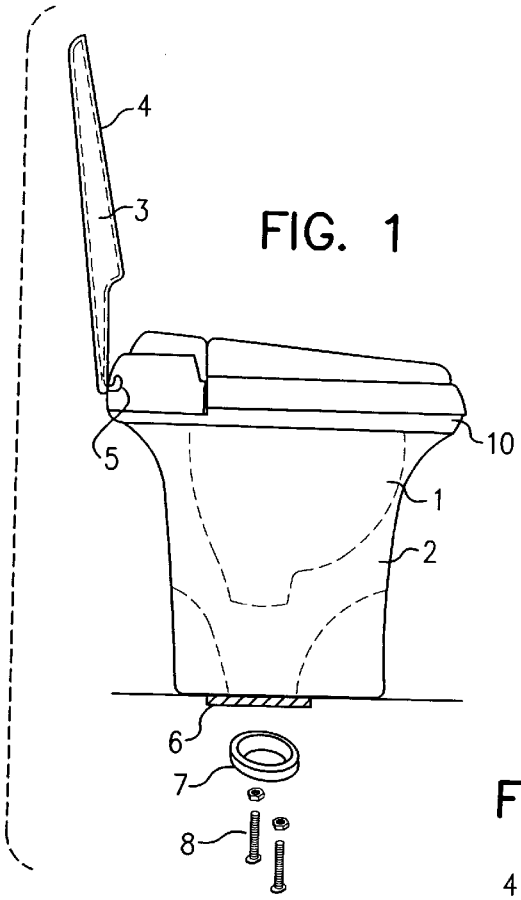
FIG. 1
FIG. 4
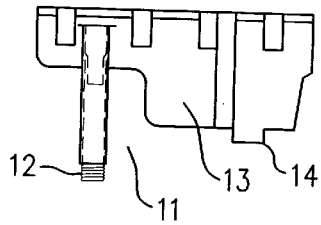
FIG. 2
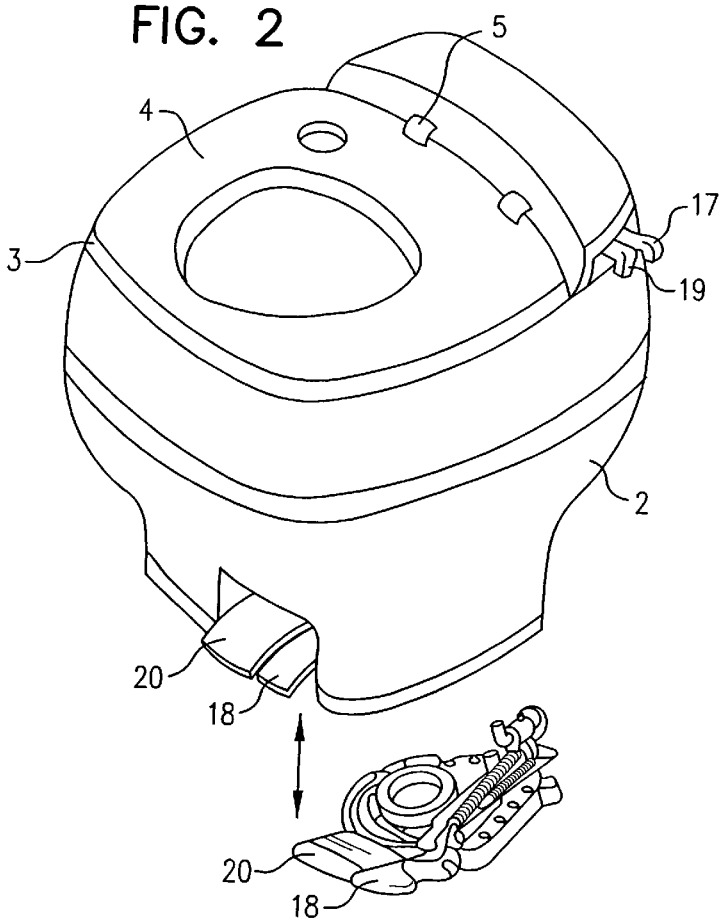

VENTILATED TOILET

FIELD OF THE INVENTION

The invention described below relates to a toilet system for the purpose of removing obnoxious odors promptly from the basin before they enter the room during toilet usage. More specifically, the subject invention pertains to ventilated toilets for use in boats or recreational vehicles.

BACKGROUND OF THE INVENTION

Various types of devices for ventilating toilet bowls have been proposed and can be categorized into several groups according to their construction and mode of operation.

A number of devices exist where the ventilation system is attached to the seat, is a part of the seat, or is built into the seat itself. Typical of these are: U.S. Pat. No. 4,620,329, which discloses a toilet having an internal channel in the seat for the conveyance of air through hollow hinge mechanisms; and U.S. Pat. No. 4,094,023, which discloses a toilet seat having a perforated suction tube attached on the underside of an exhaust tube running down that extends into the bowl. These ventilation system can cause a sanitary problem due to the presence of baffles, channels and openings along the underside of the seat and/or tubing located in the bowl which present a breeding ground for bacteria.

Other devices exist in which the ventilation system is formed in the toilet bowl independent of the water closet, and these require construction of the bowl itself and in U.S. Pat. Nos. 3,938,201 and 4,222,129. Once again, unsanitary conditions are present.

Still other systems exist which are attached to the toilet bowl or hung on the side thereof such as in U.S. Pat. No. 4,317,242. These designs result in either an inconvenient or hazardous condition.

There are ventilating devices where the ventilation is achieved through the overflow pipe, such as is exhibited in U.S. Pat. Nos. 4,232,406, 4,165,544, and 3,495,282. These inventions all suffer from insufficient airflow volume to adequately ventilate the toilet.

Ventilating devices also exist that are positioned between the seat and the toilet bowl as exhibited in U.S. Pat. Nos. 3,069,696 and 4,402,091. These devices suffer from safety and sanitation problems due to the additional tubing and vents.

A few designs provide a ventilating system by adding a vent adapter between the toilet bowl and the water tank, all in communication with one another, as exhibited in U.S. Pat. Nos. 2,777,137, 3,230,552, and U.S. Pat. No. 4,494,255. because the vent adapter is not an integral part of either the toilet bowl or the water closet, the device itself, as well as the crevices formed by the planes of connection, once again pose sanitation hazards and/or air flow constraints. Also, this exposed vent adapter is unsightly.

U.S. Pat. No. 2,351,560 uses a vent adapter positioned in the water inlet connecting the closet to the bowl, but requires a major structural change in the configuration of the water closet to house a suction fan and motor assembly, and the motor wiring creates an electrical hazard.

In general, the above, ventilation systems have one or more of the following problems: inadequate sanitation, unsightly appearance, physical obstruction, electrical shock hazard, lack of plumbing code compliance and/or expense. Also, none of the above systems are suitable for use with a recreational vehicle or boat toilet.

SUMMARY OF THE INVENTION

A recreational vehicle or boat toilet includes a bowl with a water ingress line to the bowl, and a flush mechanism for emptying the bowl after water from the water ingress line has entered the bowl. The recreational vehicle or boat toilet also includes a ventilation apparatus including an odor vent line communicating with the water ingress line and with an exit line leading to the external environment. Additionally, a water overflow line communicates with the water ingress line, with the odor vent line and with the exit line. A vacuum apparatus communicates with the exit line such that the odor passes from the odor vent line, through the exit line and to the external environment, and such that overflow water passes through the water overflow line, through the exit line into the external environment.

Preferably, a second odor vent line communicates with the bowl at one end, and with the exit line at the other end such that the exit line is the common line of communication of all of the first odor vent line, second odor vent line and water overflow line. Additionally, a common odor/water line communicates with the water ingress line and with the odor vent line. The common odor/water line is located downstream of the water ingress line and upstream of the first odor vent line. The common odor/water line is located upstream of the water overflow line with which it also preferably communicates. In this manner, overflow water from the water ingress line as well as gaseous odor collected through the water opening of the water ingress line both pass through the common odor/water line. The gaseous odor then passes through the first odor vent line due to the suction of the vacuum device while overflow water, due to gravity, passes through the common odor/water line and into the water overflow line.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 side view of a prior art recreational vehicle or boat toilet;

FIG. 2 perspective view of a prior art recreational vehicle or boat toilet;

FIG. 4 is a detailed view of the vacuum breaker assembly of the present invention.

DETAILED DESCRIPTION OF THE PREFERRED EMBODIMENTS

Figure 3:
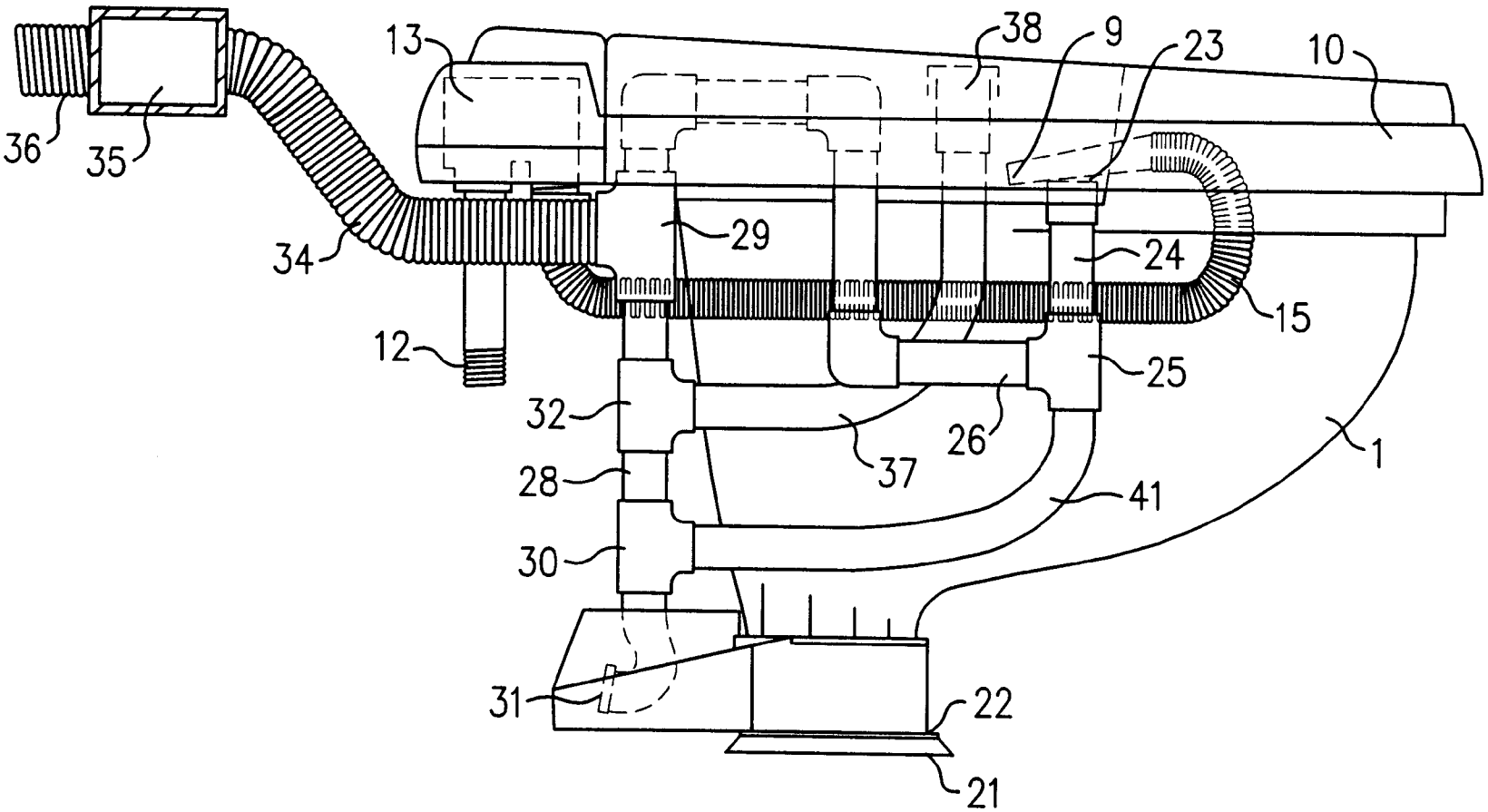
FIG. 3 is an exposed side view of the recreational vehicle or boat ventilated toilet of the present invent.

Generally, the subject invention provides a ventilated toilet for removing obnoxious odors from the toilet bowls of a recreational vehicle or boat in which the overflow pipe and the protected aperture of the circumferential flush rim of the stool-type toilet bowl draw off the odors. The odors then pass through tubular passages between the walls of the inner toilet bowl and the outer stool wall. The odors are discharged by a remote in-line exhaust fan communicating with the tubular passages. The tubular passages serve a dual purpose in that, in addition to allowing the passage of odor therethrough, the passages preferably drain overflow water entering the rim apertures or the overflow pipe such that the water is drained by a gravity flow and is fed through these tubular passages to the waste holding tank.

Referring first to FIGS. 1 and 2, a recreational vehicle or boat ventilated toilet is shown into which the components of the ventilation system of the subject invention can be placed. More specifically, bowl 1 is fitted into an outer stool 2 and is provided with hinged seat 3 and cover lid 4. Hinged seat 3 and cover lid 4 are attached to bowl 1 by hinges 5. Flange 6 is attached to the floorboard by screws. The underside of outer stool 2 is attached by closet flange bolts 8 to flange 6. Rubber seal 7 is located between flange 6 and stool 2.

Next referring to FIGS. 3 and 4, water enters the toilet through vacuum breaker assembly 11, which includes water connection supply line 12, water valve 13 and exit aperture 14. Next, the water passes through flexible conduit 15 and then through water spout 9 located on flushing rim 10 of bowl 1. Water enters bowl 1 to the desired level through water spout 9 when hand-operated rinse lever 17, or pedal-operated rinse lever 18, is activated, as shown in FIG. 2. Still referring to FIG. 2, bowl 1 is flushed when hand-operated flush lever 19 or pedal-operated flush lever 20 is activated, causing water-retaining blade 21 of FIG. 3 to slide away from blade seal 22 at the bottom of bowl 1.

Figure 5:
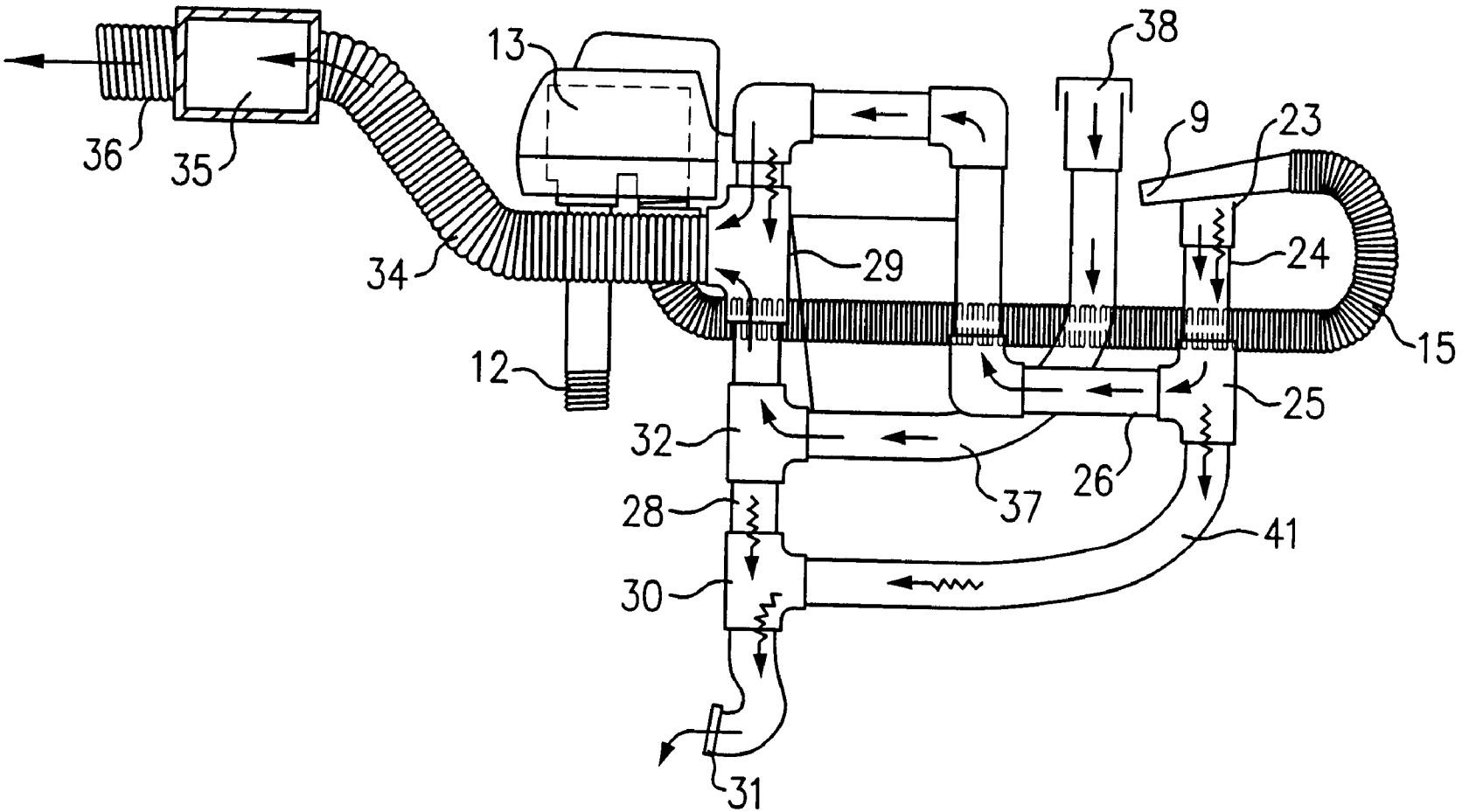
FIG. 5 is a side view of the ventilation system of the recreational vehicle or boat ventilated toilet of the present invention.

Referring to FIGS. 3 and 5, the ventilation apparatus of the present invention includes common odor/water line 24 in communication with overflow aperture 23, overflow aperture 23 being located in the interior bowl 1 and being in communication with water spout 9. As stated above, water spout 9 is connected to flexible water conduit, or water ingress line, 15. Common odor/water line 24 collects both overflow water as well as odoriferous air from bowl 1. T-connection 25 provides communication of common odor/water line 24 with both odor vent line 26 and water overflow line 41. Thus, water and odoriferous air from common odor/water line 24 are separated at T-connection 25 such that water, by the force of gravity, passes into water overflow line 41, while odoriferous air, due to vacuum forces described below, passes through odor vent line 26. Odor vent line 26 communicates with multiple exit line 28 at junction 29. Multiple exit line 28, at junction 29 communicates with vacuum hose 34 which, in turn, is connected to fan 35 that includes exit 36 which communicates with the external environment. Thus odoriferous air from odor vent line 26 passes into multiple exit line 28 at junction 29 where it then passes into vacuum hose 34 due to operation of fan 35 and is removed into the external environment through exit 36. Water overflow line 41 communicates with multiple exit line 28 at junction 30. Overflow water from bowl 1 can pass into overflow aperture 23, through common odor/water line 24, into water overflow line 41, and into junction 30 of multiple exit line 28. Gravitational force causes the water to then pass downwardly through multiple exit line 28 and into a waste holding tank through flapper 31.

Preferably, multiple exit line 28 also includes junction 32 which communicates with supplemental odor vent line 37. The other end of supplemental odor vent line 37 is located adjacent to circumferential flushing rim 10 of bowl 1, and most preferably includes a splash guard 38. Supplemental odor vent line 37 can be employed to provide additional removal of odoriferous air through multiple exit line 28 and out of vacuum hose 34 and exit 36 when the odoriferous air load is too great for odor vent line 26 to be entirely be effective. Alternatively, in another embodiment of the present invention, supplemental odor vent line 37 is the only odor vent line employed, thus, encompassing a simpler design due to the absence of odor vent line 26. Alternatively, supplemental odor vent line 37 may be absent, and only odor vent line 26 is employed for removal of odoriferous air.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. In a recreational vehicle or boat having a bowl with a water ingress line to the bowl, and having a flush mechanism for emptying the bowl after water from the water ingress line has entered the bowl, the improvement comprising:

an odor vent line communicating with said bowl and with a multiple exit line leading to the external environment;

a water overflow line communicating with said bowl, with said odor vent line and with said multiple exit line;

a second odor vent line communicating with said bowl and with said multiple exit line;

vacuum means communicating with said multiple exit line such that odor passes from said odor vent line, through said multiple exit line and to the external environment, such that odor passes from said second odor vent line, through said multiple exit line and to the external environment and such that overflow water passes through said water overflow line, through said multiple exit line and to the external environment.

2. The toilet of claim 1, further comprising a common odor/water line communicating with said bowl, said odor vent line and said water overflow line.

3. In a recreational vehicle or boat having a bowl with a water ingress line to the bowl, and having a flush mechanism for emptying the bowl after water from the water ingress line has entered the bowl, the improvement comprising:

a common odor/water line communicating with the bowl;

an odor vent line communicating with said common odor/water line and with a multiple exit line leading to the external environment;

a water overflow line communicating with said common odor/water line and with said multiple exit line;

a second odor vent line communicating with said bowl and with said multiple exit line; and vacuum means communicating with said multiple exit line such that odor passes from said common water/odor line, through said odor vent line, through said multiple exit line and to the external environment, such that odor passes from said second odor vent line, through said multiple exit line and to the external environment, and such that overflow water passes through said common water/odor line, through said water overflow line, through said multiple exit line and to the external environment.

* * * * *